United States Patent [19]

Baugus et al.

[11] Patent Number: 4,706,814

[45] Date of Patent: Nov. 17, 1987

[54] MULTIPACK CARTON WITH AUTOMATIC PANEL POSITIONING TABS

[75] Inventors: Gary Baugus, Atlanta; James R. Oliff, Austell, both of Ga.

[73] Assignee: The Mead Corporation, Dayton, Ohio

[21] Appl. No.: 889,668

[22] Filed: Jul. 28, 1986

[51] Int. Cl.[4] ..... B65D 75/00

[52] U.S. Cl. ..... 206/427; 206/148; 229/40

[58] Field of Search ..... 206/145, 147, 155, 156, 206/426, 434, 427, 429, 148, 158; 229/40

[56] References Cited

U.S. PATENT DOCUMENTS

| | | | |
|---|---|---|---|
| 518,899 | 4/1894 | Schmidt | 229/29 E |
| 2,238,545 | 4/1941 | Whiley | 206/427 |
| 2,950,041 | 8/1960 | Stone | 229/40 |
| 3,278,075 | 10/1966 | Weiss | 229/40 X |
| 3,674,137 | 7/1972 | Graser | 206/158 |
| 3,994,398 | 11/1976 | Graham | 206/434 X |
| 4,164,286 | 8/1979 | Sutherland | 206/434 |
| 4,304,329 | 12/1981 | Graser | 206/148 |
| 4,355,717 | 10/1982 | Oliff | 206/434 X |
| 4,470,503 | 9/1984 | Stone | 206/434 X |
| 4,637,515 | 1/1987 | Wilson et al. | 206/434 |

FOREIGN PATENT DOCUMENTS

| | | | |
|---|---|---|---|
| 647867 | 9/1962 | Canada | 229/40 |
| 2158037 | 11/1985 | United Kingdom | 206/427 |

*Primary Examiner*—Stephen Marcus
*Assistant Examiner*—Bryon Gehman
*Attorney, Agent, or Firm*—Erwin Doerr; Harold L. Marquis

[57] ABSTRACT

A carton in which a plurality of containers (C) are held in a complementary set of apertures (A) provided in a main panel (16) of the carton so that portions of the containers are exposed to view while other portions are enclosed by other panels (30,32; 14,18; 12,20) of the carton. An opposed pair (30,32) of these other panels for flanking body portions of the packaged containers include positioning tabs (38,40; 42,44) which extend into the container receiving apertures so that during loading and formation of the package the containers are urged against the positioning tabs which automatically cause the flanking panels to be pivoted into and held in the container flanking position.

6 Claims, 3 Drawing Figures

MULTIPACK CARTON WITH AUTOMATIC PANEL POSITIONING TABS

Figure 1:
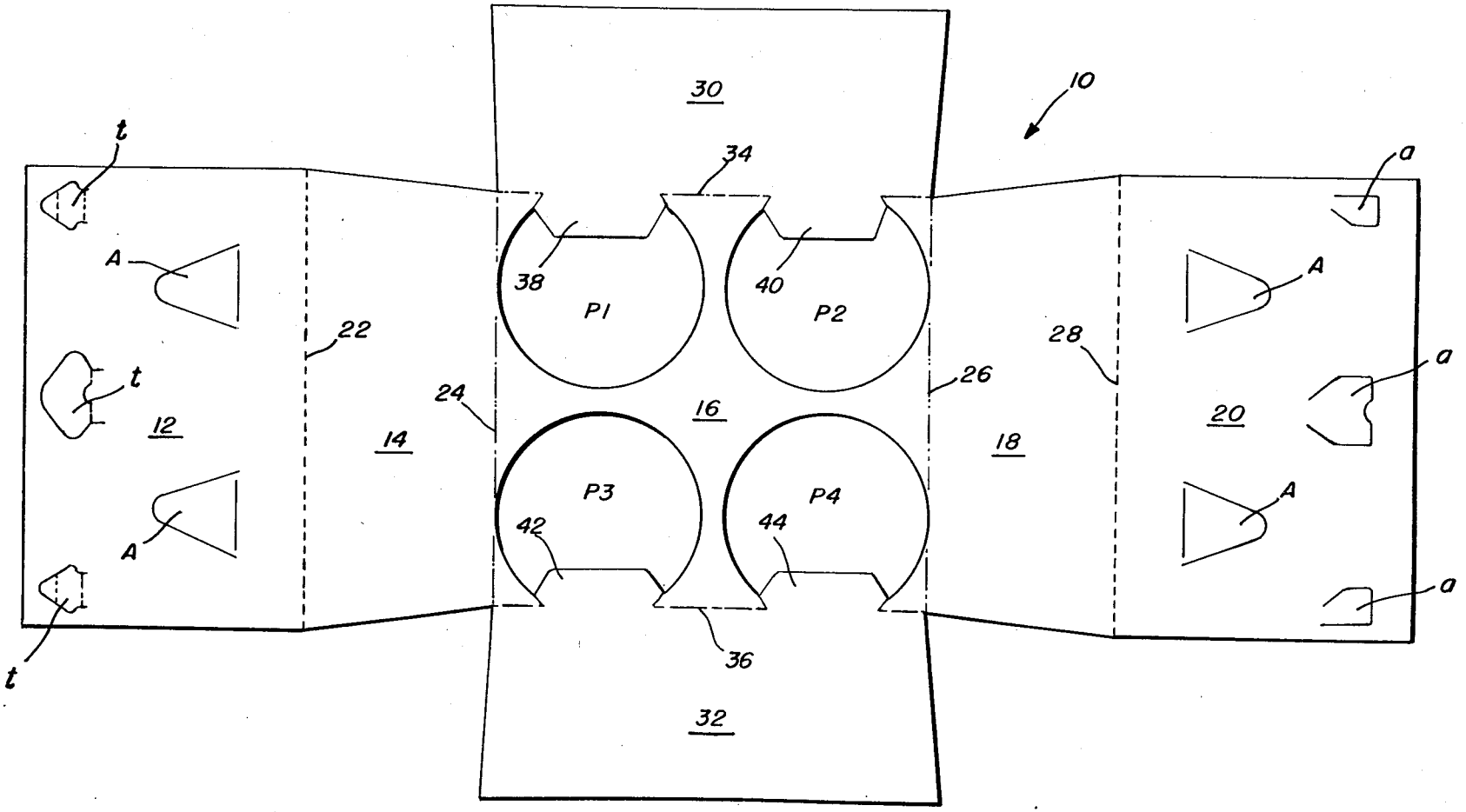

This invention relates to a carton of the type in which a plurality of containers are held in a complimentary set of container receiving apertures provided in a main panel disposed normally to the main axes of the containers such that upper or lower portions of the containers extend in one direction relative to said main panel while the remaining portions of the containers extend in an opposite direction, the containers being restrained from dislodgement from the main panel by other panels of the package. The main panel will provide either a top panel or a base panel of the carton.

The invention is particularly suitable for use with frusto-conical cups, so-called "V" or "A" cups depending on whether they have bodies which are upwardly or downwardly tapered.

In the present invention, panels for flanking body portions of the packaged containers include positioning tabs which extend into the container receiving apertures so that during loading and formation of the package the containers are urged against the positioning tabs which thereby automatically cause their associated flanking panels to be pivoted into the required container flanking position.

In one form, the invention provides a carton of the kind described characterized in that a panel for flanking body portions of the containers is hinged to each of two opposed edges of the main panel, each of the flanking panels having an integral positioning tab extending into and interrupting the space defined by a container receiving aperture in the main panel, the positioning tab being effective to induce pivoting of its associated flanking panel, about the hinged connection between that flanking panel and the main panel when a container is inserted into said container receiving aperture, into flanking relationship with that container.

According to a feature of this aspect of the invention, the positioning tab may be sized and disposed such that when the container is loaded into said container receiving aperture, force is exerted by that container against the positioning tab thereby to urge the associated flanking panel against a body portion of the container.

According to another feature of the invention one of the positioning tabs may be provided by the flanking panels for each of the main panel apertures adjacent thereto. In a preferred construction a further flanking panel is hinged to each of two other opposed edges of the main panel. Where this feature is adopted each of the further flanking panels may have an end panel hinged thereto remote from the main panel, the end panels being secured together in overlapping relationship, and substantially parallel to the main panel, across one of the ends of said containers.

According to another feature of the preferred construction, the flanking panels together may substantially hide the space present between the main panel and the overlapped end panels. In some of the arrangements of the preferred construction, the main panel is a top panel of the carton and the overlapped end panels are base panels of the carton. In other arrangements of the preferred construction the main panel is a base panel of the carton and the overlapped end panels together provide a composite top panel of the carton.

Another aspect of the invention provides a carton of the kind described characterized in that a panel for flanking body portions of the containers is hinged to each of two opposed edges of the main panel, each of the flanking panels having one positioning tab for each of the container receiving apertures adjacent thereto in the main panel, the positioning tabs extending into and interrupting the space defined by its associated aperture and being effective to induce pivoting of its associated flanking panel, about the hinged connection between that flanking panel and the main panel, when containers are loaded into the associated apertures, into flanking relationship with the containers and in that a further pair of flanking panels is hinged to each of two other opposed edges of the main panel, each of the further flanking panels having an end panel hinged thereto remote from the main panel, the end panels being secured in overlapping relationship across one of the ends of the containers and in the flanking panels together substantially cover the space present between the main panel and the overlapped end panels.

Another aspect of the invention provides a blank for forming a carton of the kind described, the blank comprising a main panel in which a plurality of container receiving apertures is formed, a first pair of flanking panels hinged to two opposed edges of the main panel, each of the first pair of flanking panels having for each of the container receiving apertures disposed adjacent thereto an integral positioning tab extending into and interrupting the space defined by that article receiving aperture, a second pair of flanking panels hinged to two other opposed edges of the main panel each of the second pair of flanking panels having an end panel hinged thereto.

According to a feature of the invention, each of the end panels may include complimentary locking elements by which the end panels can be secured together in overlapping relationship According to another feature of the invention each of the flanking panels has opposed edges which are divergent in a direction away from the main panel.

Figure 2:
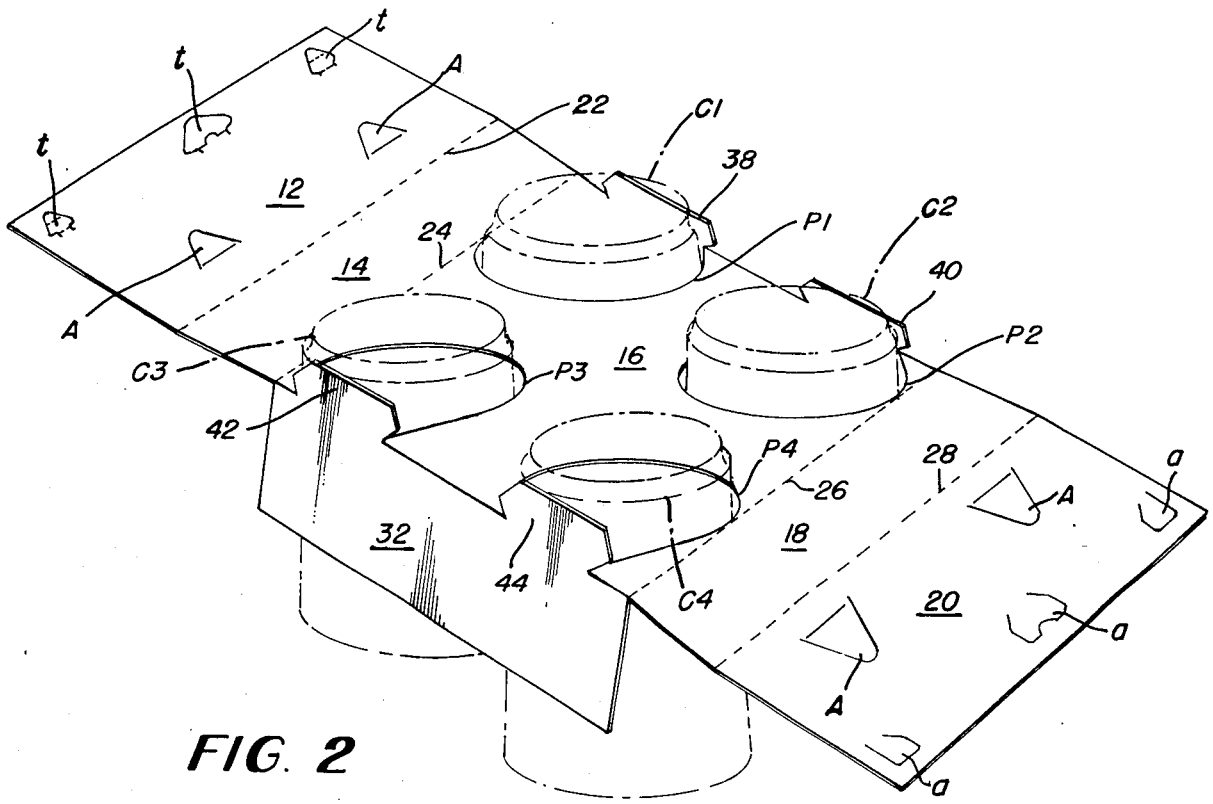
Figure 3:
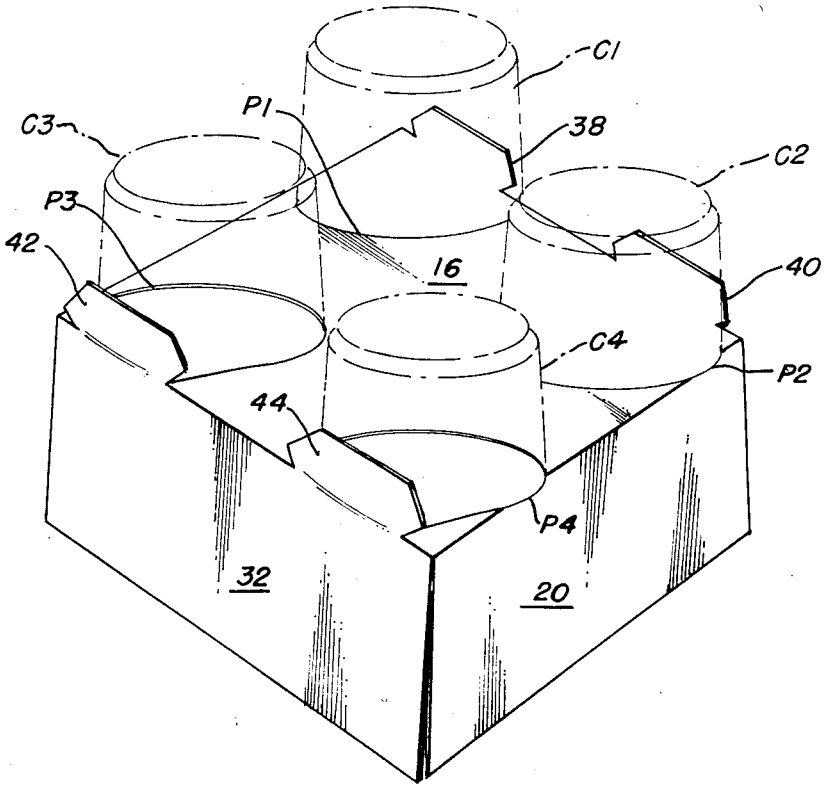

An embodiment of the invention will now be described, by way of example, with reference to the accompanying drawings, in which:

FIG. 1 is a plan view of a blank for use in forming a carton according to the invention, FIG. 2 is a perspective view of the carton partially completed during loading, and FIG. 3 is a perspective view of the completed and loaded carton.

Referring first to FIG. 1, an elongate blank 10 formed from paperboard or similar foldable sheet material comprises, in series, a first end panel which provides a base panel 12, a first flanking panel which provides side wall panel 14, a main panel 16 which provides a top, a second flanking panel which provides side wall panel 18 and a second end panel which provides base panel 20 hinged one to the next along transverse fold line 22, interrupted fold lines 24 and 26 and fold line 28, respectively. A second pair of flanking panels providing end walls 30 and 32 are hinged to respective ones of the opposed longitudinal edges of top panel 16 along interrupted longitudinal fold lines 34 and 36. As best seen in FIG. 1, fold lines 24, 26 and 34, 36 are substantially straight lines and together define the side edges of the rectangular main panel 16. Thus, the blank has an overall cross-shaped configuration in which top panel 16 is centrally disposed.

The blank is adapted to be manipulated into a carton of the wrap-around so called neck-through variety and to this end each of the base panels is provided with cooperating locking elements while the top panel includes apertures through which parts of the packaged items extend so that their upper portions are exposed to view.

Base panel 12 includes a row of locking tabs "t" which engage in locking apertures defined by retaining tabs "a" in base panel 20 when the base panels are correctly aligned in overlapping relationship as is well known in the art. In order to bring the base panel locking elements into alignment and to produce a tight package, tightening apertures "A" are formed in each of the base panels as is also well known in the art.

The product receiving apertures $P_1$–$P_4$ which are struck from the top panel are arranged in two rows of two apertures each, although other arrangements e.g. $3\times2$ are envisaged. A pair of positioning tabs 38 and 40 integral with end flanking panel 30 extend from the interrupted fold line 34 into the space defined by apertures $P_1$ and $P_2$, respectively, so that each aperture is partially obscured by a respective one of the positioning tabs. Likewise, positioning tabs 42 and 44 integral with end flanking panel 32 extend into the space defined by apertures $P_3$ and $P_4$, respectively.

The blank 10 is applied to a group of containers $C_1$–$C_4$, which in this embodiment are frusto-conical plastics containers so called "A-cups", initially so that top panel of the blank 16 overlies the container tops with apertures $P_1$–$P_4$ in register with respective ones of the containers $C_1$–$C_4$.

Thereafter, the blank is forced downwardly, e.g. by downward pressure on side flanking panels 14 and 18 so that the tops of the containers begin to enter respective ones of the apertures and peripheral portions of the tops strike against the positioning tabs.

As application of the blank relative to the containers continues, end flanking panels 30 and 32 are caused to pivot downwardly, relative to top panel 16, about interrupted fold lines 34 and 36, respectively, by virtue of the upward displacement of the positioning tabs by the containers.

This partially loaded condition of the package is shown by FIG. 2. The folding process continues so that the containers progressively are more fully inserted into the top wall apertures "P" and the side flanking panels are folded downwardly, relative to top panel 16, about transverse fold lines 24 and 26 to bring the side flanking panels into upright flanking relationship with respect to the body portions of the containers. Likewise, continued pivoting of the end flanking panels 30,32 by further upward displacement of the positioning tabs brings those panels together with the positioning tabs into upright flanking relationship with respect to the body portions of the containers.

The folding process is then completed by causing base panels 12,20 to be folded about fold lines 22 and 28, respectively into overlapping relationship beneath the bases of the containers whereupon the base panels are drawn together by means of tightening apertures A and interlocked by means of the locking elements "a" and "t" as is well known. The tightening action assists in achieving a secure package and, in particular, maintains the side flanking panels 14 and 18 in close abutting relationship with the container bodies. The end flanking panels 30 and 32 are detached from the base panels but are nevertheless also maintained in close abutting relationship with the container bodies. This latter feature is achieved in that the positioning tabs are subjected to an outwardly directed force by virtue of the presence of an adjacent container which in turn creates a moment about the fold lines 34 and 36 so that the end flanking panels 30 and 32 are urged inwardly against the container bodies. The downwardly flared configuration of the containers has the effect of increasing the outward force exerted on the positioning flaps in proportion to the amount by which the containers project above the top wall 16 of the package limited of course by the relative diameters of the container receiving apertures and the container diameters.

Each of the flanking panels 14,18 and 30,32 (see FIG. 1) has opposed side edges which are divergent in a direction extending away from the main panel 16. As shown in FIG. 1, the side edges of flanking panels 30,32 are unattached to the side edges of said flanking panels 14, 18 througout the entire length thereof. This feature produces a package (see FIG. 3) which has downwardly and outwardly directed sides.

It is envisaged that the present invention is also useful in relation to inverted frusto-conical containers, the so-called "V"-shaped cups, in which the package is presented upturned or inverted relative to that shown in FIG. 3. In such an arrangement it is further envisaged that loading would be performed by inserting the containers downwardly into the apertures "P" so that the panel 16 of the embodiment first described would provide a bottom panel whereas the two overlapping base panels 12,20 would form a composite top panel and may be secured together as by gluing. During loading, the bases of the containers would be caused to bear against the positioning tabs so as to cause upward pivoting of the end flanking panels. The side flanking panels also would be folded upwardly followed by overlapping and securing together the composite top panel.

What we claim is:

1. A carton for a plurality of containers comprising a rectangular main panel having a plurality of apertures for receiving and retaining said containing, side wall panels foldably joined to opposing side edges of said main panel, end panels joined to said side wall panels and folded into overlapping relationship, and flanking panels hinged at substantially straight fold lines located at the remaining side edges of said main panel, each of the flanking panels having side edges which are unattached to the side edges of the side walls panels, each of said flanking panels having at least one integral positioning tab extending into and interrupting the area defined by an adjacent container receiving aperture, said positioning tab being effective to induce pivoting of its associated flanking panel about the hinged connection thereof with said main panel when a container is inserted into said adjacent container receiving aperture, so that the flanking panels are brought into an upright relationship with respect to the body portions of the container that is substantially the same as th upright relationship of the side wall panels when the carton is formed about the containers.

2. The carton as claimed in claim 1, further characterized in that said positioning tab is sized and disposed such that when said container is inserted into said container receiving aperture, force is exerted by said container against said positioning tab thereby to urge the associated flanking panel against a body portion of said container.

3. The carton as claimed in claim 2, further characterized in that a positioning tab is provided by said flanking panels for each of adjacent container receiving apertures.

4. The carton as claimed in claim 3, further characterized in that said flanking panels together substantially cover the space between said main panel and said overlapped end panels.

5. The carton as claimed in claim 1, further characterized in that said main panel forms the top of said carton and said overlapped end panels form the base of said carton.

6. The carton according to claim 1, further characterized in that said main panel forms the base of said carton and said overlapped end panels together provide a composite top panel of said carton.

* * * * *